US006409428B1

(12) United States Patent
Moog

(10) Patent No.: US 6,409,428 B1
(45) Date of Patent: Jun. 25, 2002

(54) APPARATUS FOR SECURING A TUBULAR STRUCTURE TO AN ANCHOR

(75) Inventor: Olivier Moog, Aspach-le-Haut (FR)

(73) Assignee: Techlam, Cernay Cedex (FR)

( * ) Notice: Subject to any disclaimer, the term of this patent is extended or adjusted under 35 U.S.C. 154(b) by 0 days.

(21) Appl. No.: 09/670,803

(22) Filed: Sep. 28, 2000

(51) Int. Cl.[7] ..... F16L 1/16

(52) U.S. Cl. ..... 405/169; 405/172; 405/224.2; 166/343; 166/342

(58) Field of Search ..... 405/169, 172, 405/158, 170, 224.2; 166/343, 341, 342, 345, 349, 351, 350, 359, 360, 338

(56) References Cited

U.S. PATENT DOCUMENTS

| | | | | |
|---|---|---|---|---|
| 3,696,864 A | | 10/1972 | Brown | |
| 4,086,778 A | * | 5/1978 | Latham et al. | 166/343 |
| 4,459,931 A | | 7/1984 | Glidden | |
| 4,580,636 A | * | 4/1986 | Johnson, III et al. | 166/343 |
| 4,620,818 A | * | 11/1986 | Langner | 405/169 |
| 4,641,998 A | * | 2/1987 | Baugh | 405/169 |
| 4,676,696 A | * | 6/1987 | Laursen | 405/169 |
| 4,784,523 A | | 11/1988 | Louis et al. | |
| 5,088,558 A | * | 2/1992 | Mohn | 166/343 |
| 5,807,027 A | * | 9/1998 | Ostergaard | 405/169 |

FOREIGN PATENT DOCUMENTS

| | | |
|---|---|---|
| EP | 0 302 546 | 2/1989 |

* cited by examiner

*Primary Examiner*—Heather Shackelford
*Assistant Examiner*—Frederick L. Lagman
(74) *Attorney, Agent, or Firm*—Bacon & Thomas, PLLC

(57) ABSTRACT

An apparatus for releasably securing a tubular structure of a floating installation to an anchor fixedly secured to an underwater floor has a first connection element mounted at one end of the tubular structure and a second connection element configured at one end to couple with the first connection element. The second connection element includes a pair of guides secured thereto which extend horizontally therefrom. A hinge device connects the second connection element to the anchor such that the second connection element is pivotably connected to the anchor. A plurality of cables connect to both the tubular structure and the anchor, whereby the pair of guides cooperate with the cables such that when the cables are under tension, the cables urge the second connection element to pivot and align with the first connection element.

7 Claims, 4 Drawing Sheets

APPARATUS FOR SECURING A TUBULAR STRUCTURE TO AN ANCHOR

FIELD OF THE INVENTION

The invention relates to apparatus enabling a tubular structure to be connected and locked to an anchor under water. The field of application of the invention is more particularly that of anchoring floating installations for drilling and extracting oil from under water.

BACKGROUND OF THE INVENTION

In the above field, it is common practice to use surface installations which are fixed to the bottom by means of a plurality of tubular structures (or "legs" or "risers") whose bottom ends are locked to anchors which are fixed to the bottom.

For this purpose, it is known to use connection devices comprising connection elements connected respectively to one end of the tubular structure and to the anchor for the purpose of locking the tubular structure to the anchor merely by moving the tubular structure in translation parallel to its axis Such connection devices are described in particular in U.S. Pat. Nos. 4,907,914 and 4,943,188. The connection elements include portions in relief forming guides and co-operating with one another to achieve locking by relative rotation, itself induced by the movement in translation of the tubular structure.

After locking has been achieved and throughout the time the platform is in service, it is necessary to ensure that the tubular structures are capable of pivoting relative to the anchors. This makes it possible accommodate forces acting on the floating installation, e.g. due to currents or to violent winds tending to move it horizontally relative to the bottom. For this purpose, one and/or both of the connection elements can be mounted on hinge means allowing the tubular structure to pivot about a point situated on its axis. The hinge means can be in the form of a ball or a spherical abutment interposed between one of the connection elements and one end of the tubular structure, or between the other connection element and the anchor The hinge means can be constituted by a laminated spherical abutment made up of alternating layers of metal and of elastomer that are bonded to one another, as also described in U.S. Pat. Nos. 4,943,188 and 4,907,914.

With those known apparatuses, difficulties can be encountered when the connection elements are not properly aligned during docking between the tubular structure and the anchor. In the event of mis-alignment, the radial (or horizontal) component exerted during docking can be insufficient or unsuitable for causing the hinge-mounted connection element to pivot into alignment with the other connection element.

OBJECT AND BRIEF DESCRIPTION OF THE INVENTION

The main object of the invention is to resolve the above problem by proposing a connection device whereby a tubular structure and an anchor can be connected together without difficulty even in the event of mis-alignment between the connection elements when they are brought together.

This object is achieved by connection apparatus of the type comprising:

first and second connection elements connected respectively to one end of the tubular structure and to the anchor for locking the tubular structure to the anchor by movement of the tubular structure in translation substantially parallel to its axis; and hinge means connected to at least one of the connection elements to make it possible, when the tubular structure is connected to the anchor, for the tubular structure to pivot relative to the anchor about a point situated substantially on the axis of the tubular structure;

in which apparatus;

cables are connected respectively to the tubular structure and to the anchor to enable traction to be exerted on the tubular structure to enable it to be connected to the anchor; and said cables co-operate with guide means secured to a connection element that is connected to the hinge means such that when the cables are under tension, when traction is applied thereto, they act on said connection element so as to cause it to pivot, where necessary, in order to come into alignment with the other connection element Thus, the traction of the cables serves not only to move the connection elements towards each other for engagement purposes, but also to bring them automatically into alignment.

BRIEF DESCRIPTION OF THE DRAWINGS

The invention will be better understood on reading the following detailed description given with reference to the accompanying drawings, in which.

DESCRIPTION OF PREFERRED EMBODIMENTS OF THE INVENTION

Figure 1:
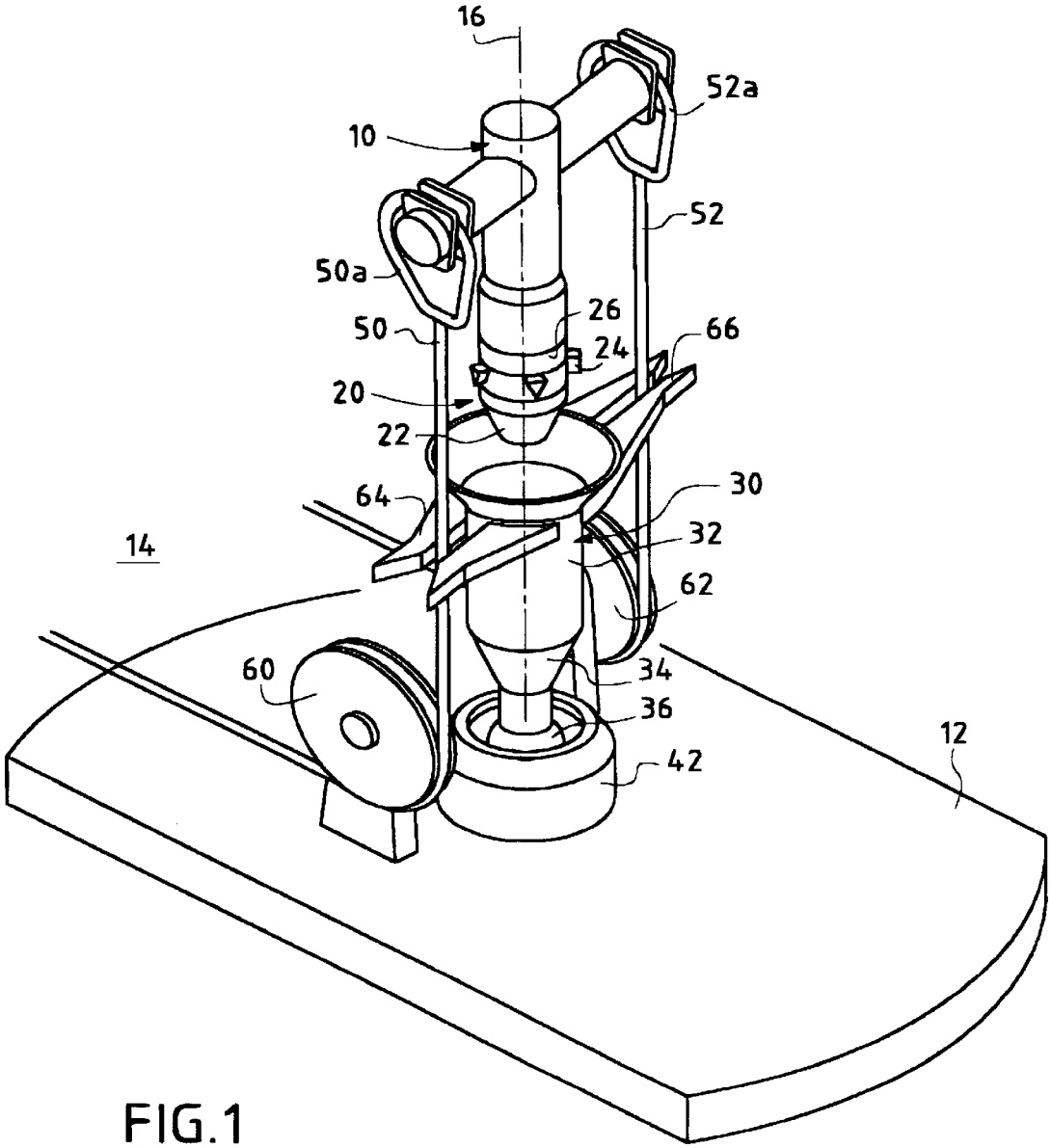
FIG. 1 is a highly description perspective view of an embodiment of connection apparatus of the invention.
Figure 2:
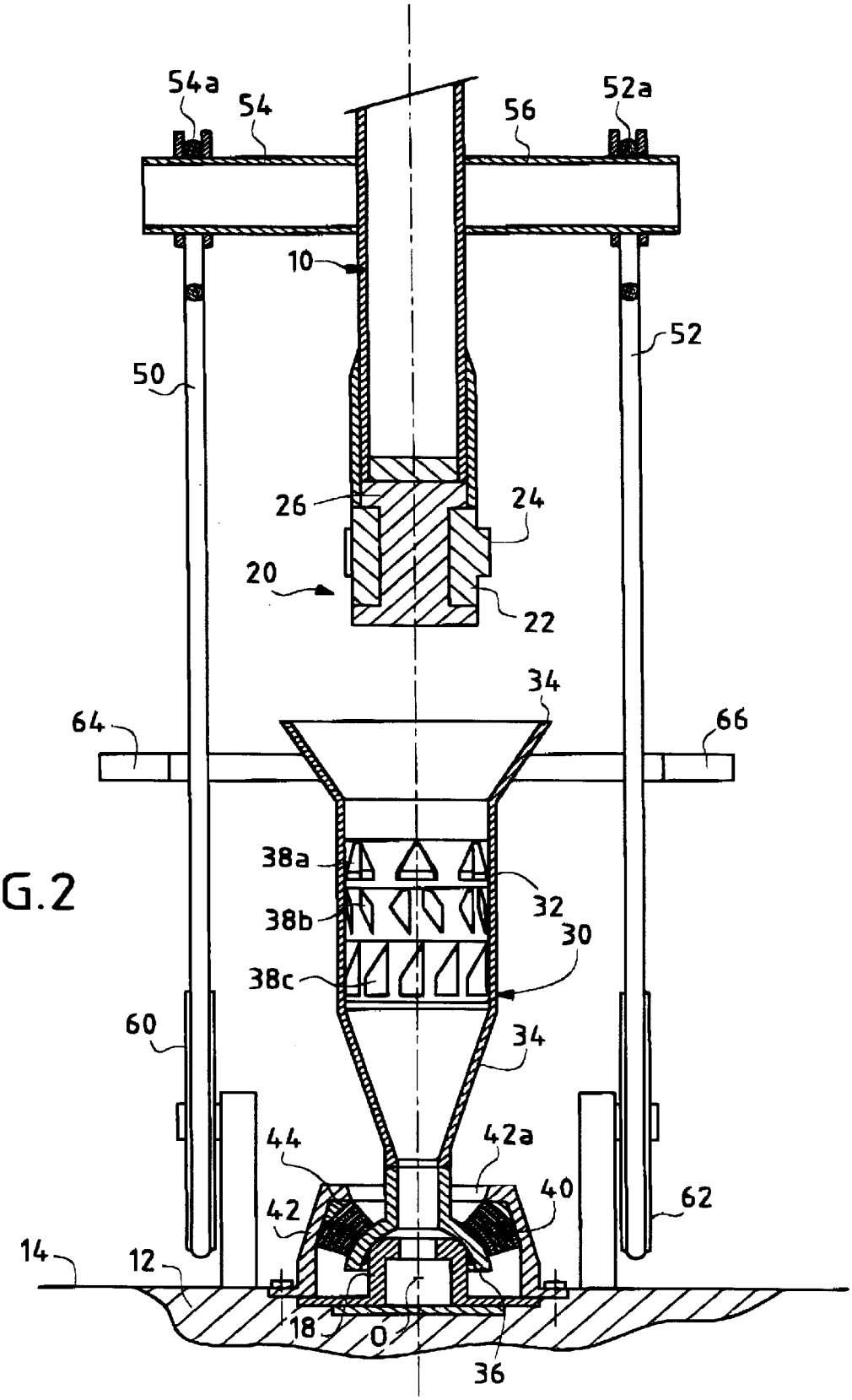
FIG. 2 is a highly diagrammatic elevation and mid-section view of the connection apparatus of FIG. 1.

FIGS. 1 and 2 show an embodiment of connection apparatus of the invention for connecting an underwater tubular structure (or "riser") 10 to an anchor 12 fixed to a bottom 14 under water. In the figures, the tubular structure 10 and the anchor 12 are shown in the disconnected or not yet connected state. The top end (not shown) of the tubular structure 10 is connected to a floating installation, e.g. a platform or a buoy, which serves to hold the tubular structure under tension once it has been anchored.

A male connection element 20 is fixed to the bottom end of the tubular structure 10. This element has a ring 22 provided at its periphery with projecting portions or tenons 24. The ring 22 is free to rotate about the axis 16 of the tubular structure. The ring 22 bears against a piece 26 which is fixed to the end of the tubular structure 20, e.g. by welding.

The anchor 12 supports a female connection element 30 via a spherical hinge abutment 40 received in a housing 42 fixed to the anchor 12. The female connection element 30 has a cylindrical portion 32 of annular section constituting a receptacle for the male connection element. At its top end, the cylindrical portion 32 flares to form an upside-down cone 34 for guidance or docking purposes. At its bottom end, the cylindrical portion 32 is connected to a piece 36 via a tubular portion 34, possibly of tapering diameter, through an opening 42*a* in the housing 42. The piece 36 has a portion in the form of a spherical cap which is secured, e.g. by welding, to a base 18 that is secured to the anchor 12. On its bottom wall, the cylindrical portion 32 has three series of projecting portions or tenons 38*a*, 38*b*, and 38*c* which are distributed around its axis, having guidance and abutment functions.

The piece 36 in the form of a spherical cap constitutes one of the plates of the hinge abutment 40, the other plate being constituted by a ring 44. The outside surface of the ring 44 bears against the inside wall of the housing 42. The abutment 44 is a laminated abutment made up of layers of rigid material, e.g. metal, alternating with layers of elastomer, the layers being bonded to one another. The faces of the layers of the laminated abutment and the facing faces of the ring 44 and of the piece 36 between which they are received are concentric spherical surfaces centered on a point O on the axis of the cylindrical portion 32 (which coincides with the axis of the tubular structure when it is connected to the anchor).

Cables 50 and 52 have ends 50*a* and 52*a* hooked onto arms 54 and 56 which are themselves fixed to the tubular structure 10. The arms 54 and 56 project radially from two diametrically-opposite locations of the tubular structure 10 close to its bottom end. The cables 50 and 52 pass over deflector sheaves 60 and 62 which are fixed to the anchor 12.

On their paths between the arms 54, 56 and the sheaves 60, 62, the cables 50, 52 pass through guides 64, 66 which are secured to the connection element 30. In the example shown, each guide 64, 66 is in the form of a fork extending radially from the outside surface portion of the docking cone 34, the forks 64, 66 being connected thereto at diametrically-opposite locations. Each fork 64, 66 has a flared end to facilitate lateral insertion of the cable.

When traction is exerted on the cables 50 and 52 via their ends (not shown) remote from their ends connected to the tubular structure 10, the structure is moved towards the anchor 12. This traction can be produced by means of a winch installed on a surface vessel.

When the male connection element 20 penetrates axially into the female connection element 30, the tenons 24 co-operate with the guide tenons 38*a* and 38*c* to bring the tenons 24 into vertical relationship with the abutment tenons 38b by rotating the ring 22. This rotation is produced by the tenons 24 coming into contact with the tenons 38*a*, 38*c* under the effect of the axial movement imposed by the cables 50, 52 The traction on the cables is then released and the buoyancy of the platform and the tubular structure 10 causes the male connection element to rise and become locked with the female element by co-operation between the tenons 24 and the abutment tenons 38*b*. Subsequent downward traction on the tubular structure enables the connection elements to be unlocked, with mutual disengagement thereof being caused by the tubular structure 10 being allowed to rise. Disconnection of the male connection element is guided by co-operation between the tenons of the male and female elements, with the ring 22 rotating.

Connection and disconnection means enabling locking and unlocking by relative axial displacement are known in themselves from above-cited U.S. Pat. Nos. 4,907,914 and 4,943,188.

Figure 3:
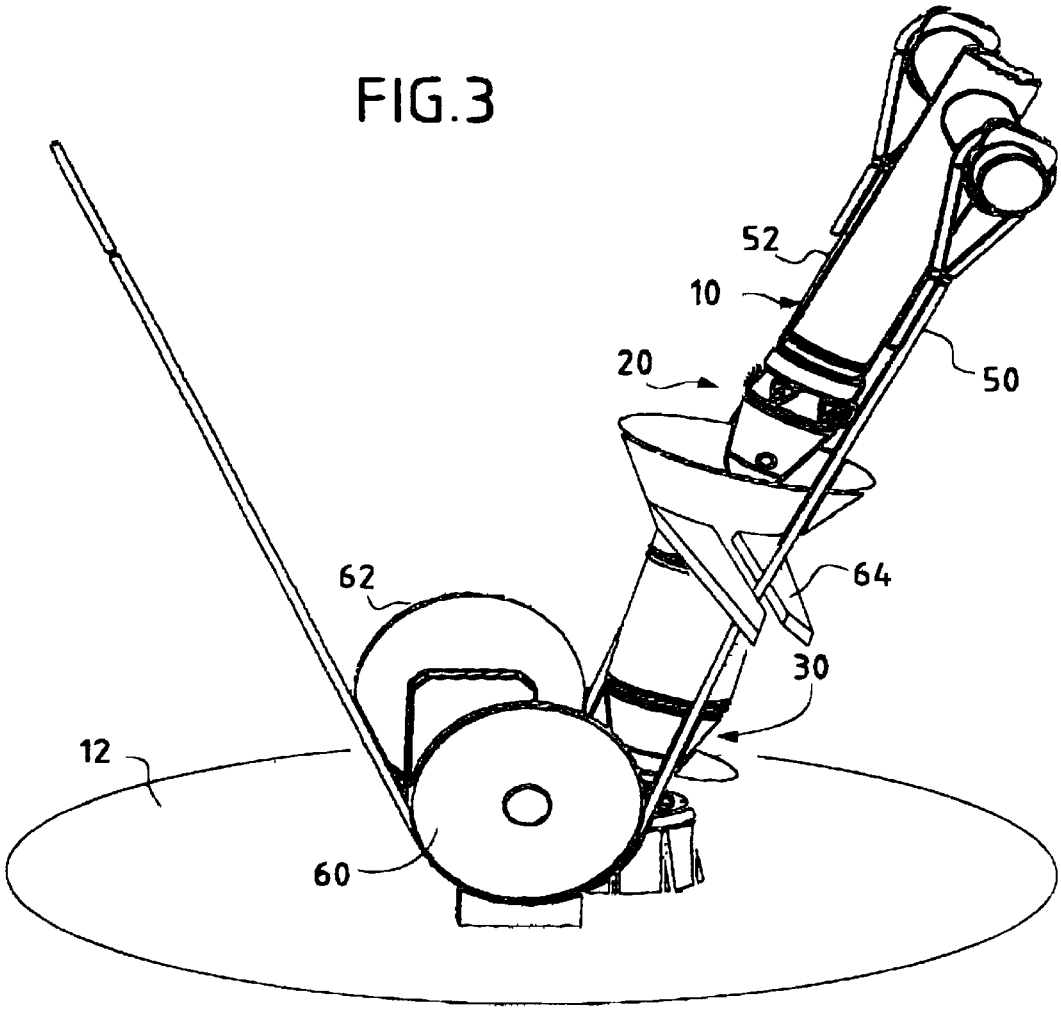
FIG. 3 is a highly diagrammatic elevation view of the connection apparatus of FIGS. 1 and 2 during docking of the connection elements.

If the connection elements 20 and 30 are not in proper alignment during locking, as shown in FIG. 3, then while a traction force is being exerted on the cables 50 and 52 to keep them under tension, a radial or horizontal component is developed on the guides 64, 66. As a result the female connection element is caused to tilt by pivoting about the point O, so as to come back into alignment with the male connection element. To make pivoting against the stiffness of the laminated abutment 40 easier, it is preferable for the guides 64, 66 to be situated close to the top end of the connection element 30 furthest away from the point O, as in the example shown.

Figure 4:
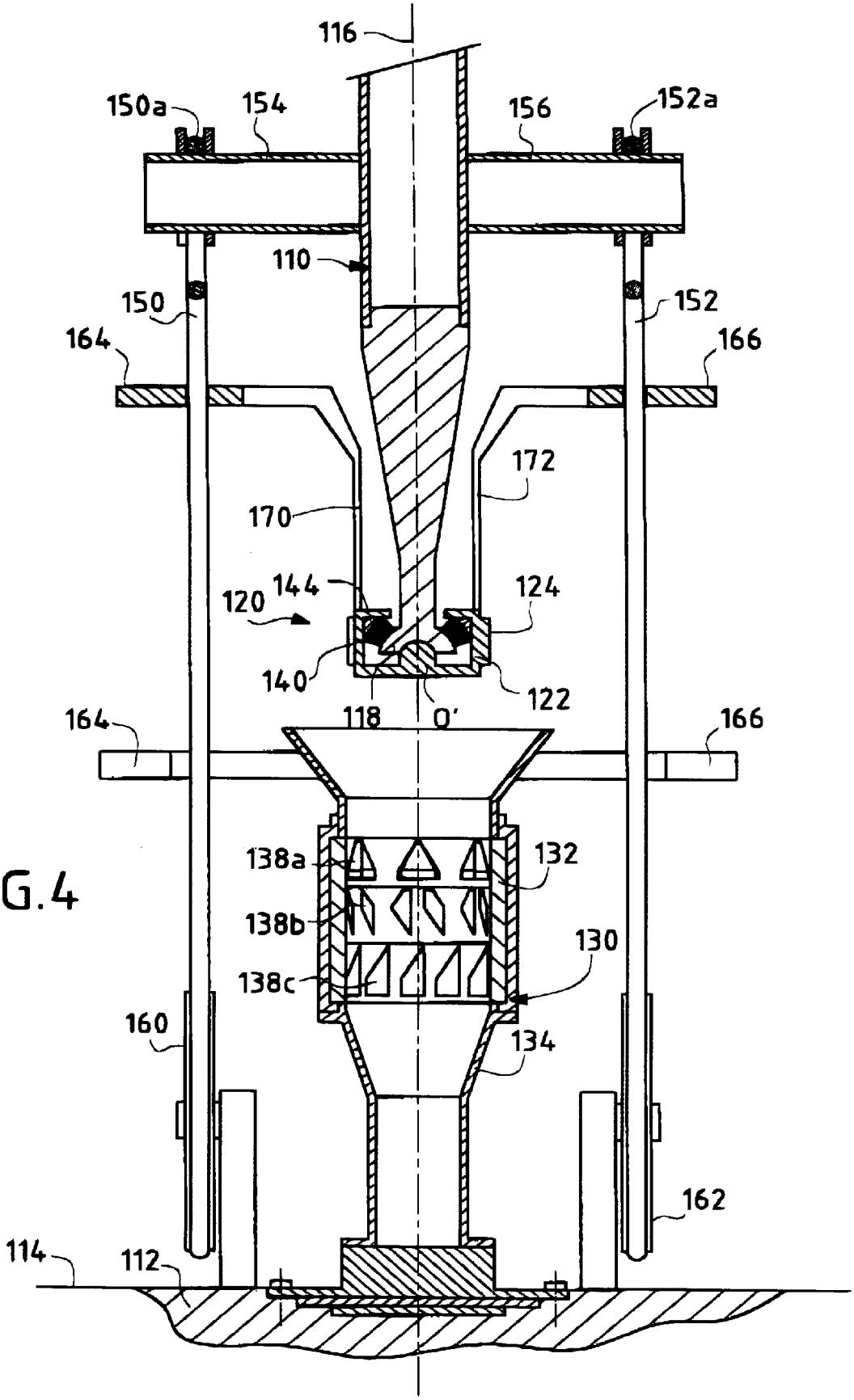
FIG. 4 is a highly diagrammatic elevation and mid-section view of another embodiment of apparatus of the invention.

FIG. 4 shows another embodiment of the invention which differs from that of FIGS. 1 to 3 in that the hinge means enabling the tubular structure to pivot are located not between the anchor and the female connection element, but between the tubular structure and the male connection element.

In FIG. 4, an underwater tubular structure 110 is provided at one end with a male connection element 120 for locking to a female connection element 130 carried by an anchor 112 carried on an underwater bottom 114. At its other end (not shown), the tubular structure 10 is connected to a floating installation.

The male connection element 120 has an annular ring 122 provided at its periphery with tenons 124. The ring 122 is connected to the bottom end of the tubular structure 110 via a spherical hinge abutment 140.

The abutment 140 is a laminated abutment comprising rigid layers, e.g. made of metal, alternating with layers of elastomer, the layers being bonded to one another. It is housed between a plate 118 in the form of a spherical cap secured to the tubular structure 110 and a plate 144 constituted by a ring which is connected to the ring 122. The spherical surfaces of the faces of the layers of the abutment 140 and of the faces of the cap 118 and of the ring 144 between which the abutment 140 is located share a common center O' situated on the axis 116 of the tubular structure 110.

The female connection element 130 has a cylindrical ring 132 which is free to rotate about its vertical axis inside a ferrule 134. The ferrule 134 is connected via a tubular portion of tapering diameter to a base 136 secured to the anchor 112. On its inside face, the ring 132 has several series of tenons 138*a*, 138*b*, and 138*c* having guidance and abutment functions.

Cables 150, 152 have ends 150*a*, 152*a* secured to arms 154, 156 fixed to diametrically-opposite locations on the tubular structure 110, and they pass over deflector sheaves 160, 162 fixed to the anchor 112, as in the above-described embodiment.

On their path between the arms 154, 156 and the sheaves 160, 162, the cables 150, 152 pass through guides 164, 166 secured to the connection element 120. In the example shown, each guide 164, 166 is constituted by a ring through which one of the cables 150, 152 passes and carried by a bracket 170, 172 fixed to the top portion of the ring 122.

The connection device of FIG. 4 operates in similar manner to that of FIGS. 1 to 3. The tenons 124 of the connection element 120 co-operate with the tenons 138*a*, 138*b*, and 138*c* of the connection element 130 to enable the connection elements to be locked and unlocked by movement in axial translation with the ring 132 rotating.

In the event of mis-alignment when establishing the connection between the tubular structure 110 and the anchor 112, the tension exerted on the cables 150, 152 applies a component to the guides 160, 162 causing the male connection element 120 to pivot about the point O', thus realigning the element 120 with the vertical female connection element 130.

It will be clear to the person skilled in the art that variants can be made to the embodiments described above without going beyond the ambit of the invention.

Thus, in the first embodiment of FIGS. 1 to 3, it is possible to have a male connection element with a fixed ring and a female connection element with a ring that can move in rotation, as is the case in FIG. 4.

Conversely, in the second embodiment of FIG. 4, it is possible to have a male connection element with a ring that is movable in rotation and a female connection element with a cylindrical portion that is fixed, as in the embodiment of FIGS. 1 to 3.

In addition, locking means other than those described can be used for the purpose of locking a male connection element to a female connection element by imparting relative movement in translation.

It is also possible to associate the female connection element with the tubular structure and the male connection element with the anchor.

It should also be observed that hinge means other than spherical laminated abutments could be used, e.g. conventional ball-and-socket joints or universal joint systems.

Finally, cable guide devices other than in the form of forks or rings could be provided, providing they are suitable for transferring a force that results from the tension in the cable in the event of misalignment, and the guide devices can optionally be provided with means for locking the cables where they pass through them.

What is claimed is:

1. An apparatus for releasably securing a tubular structure of a floating installation to an anchor fixedly secured to an underwater floor comprising:

a first connection element mounted at one end of said tubular structure;

a second connection element configured and dimensioned at one end to couple with said first connection element along generally vertical central axes defined by said first and second connection elements, said second connection element including at least a pair of guides secured thereto;

a hinge device connecting said second connection element to said anchor such that said second connection element is pivotably connected to said anchor; and a plurality of cables connecting to both said tubular structure and said anchor, said pair of guides cooperating with said cables such that when said cables are under tension, said cables urge said second connection element to pivot and align with said first connection element.

2. The apparatus according to claim 1 wherein a plurality of fastening points are secured to the tubular structure and a plurality of deflection points are secured to the anchor, said cables connecting to said fastening points, passing through said guides and cooperating with said deflection points.

3. The apparatus according to claim 1, wherein the hinge device includes a spherical laminated abutment connected to said second connection element.

4. The apparatus according to claim 1 wherein the first connection element has a plurality of tenons extending horizontally therefrom along a radius centered on the vertical axis, said second connection element having a plurality of guide tenons disposed along an internal surface thereof and being dimensioned and configured to receive said tenons of said first connection element.

5. The apparatus according to claim 4 wherein said anchor is configured and dimensioned to receive and retain said spherical laminated abutment connected to said second connection element.

6. The apparatus according to claim 1 wherein said at least pair of guides extend horizontally from an external surface of said second connection element relative to said vertical central axis.

7. The apparatus according to claim 1 wherein said hinge device is a ball joint configured for movement of said second connection element with respect to said anchor with at least two degrees of freedom.

* * * * *